US012637868B2

(12) United States Patent
Voss et al.

(10) Patent No.: US 12,637,868 B2
(45) Date of Patent: May 26, 2026

(54) MODULAR FREE-STANDING BALLASTED GUARDRAIL SYSTEM

(71) Applicant: SAYFA R&D PTY LTD, Boronia (AU)

(72) Inventors: Barry Voss, Boronia (AU); Murray Voss, Boronia (AU)

(73) Assignee: SAYFA R&D PTY LTD, Boronia (AU)

( * ) Notice: Subject to any disclaimer, the term of this patent is extended or adjusted under 35 U.S.C. 154(b) by 204 days.

(21) Appl. No.: 18/711,029

(22) PCT Filed: Dec. 13, 2023

(86) PCT No.: PCT/AU2023/051290
§ 371 (c)(1),
(2) Date: May 16, 2024

(87) PCT Pub. No.: WO2024/092325
PCT Pub. Date: May 10, 2024

(65) Prior Publication Data

US 2025/0067070 A1 Feb. 27, 2025

(30) Foreign Application Priority Data

Dec. 14, 2022 (AU) ..... 2022903834

(51) Int. Cl.
*E04G 21/32* (2006.01)
*E04G 5/02* (2006.01)
*E04G 5/14* (2006.01)

(52) U.S. Cl.
CPC ..... *E04G 21/3238* (2013.01); *E04G 5/025* (2013.01); *E04G 5/145* (2013.01)

(58) Field of Classification Search
CPC ..... E01F 9/692; E01F 13/02; E01F 13/022; E04F 11/1812; E04G 5/02; E04G 5/025;
(Continued)

(56) References Cited

U.S. PATENT DOCUMENTS 6,848,679 B2 * 2/2005 Higgs ..... E04G 21/3238 256/65.14
9,677,299 B2 * 6/2017 Whiteley ..... E04G 21/3238
(Continued)

FOREIGN PATENT DOCUMENTS

AU 2016216660 A1 * 3/2017 ..... E04G 21/32
AU 20170100285 A4 4/2017
(Continued)

OTHER PUBLICATIONS

International Search Report & Written Opinion dated Feb. 16, 2024 from PCT Application No. PCT/AU2023/051290 (10 pages).
(Continued)

*Primary Examiner* — Josh Skroupa
(74) *Attorney, Agent, or Firm* — INNOVATION CAPITAL LAW GROUP, LLP; Vic Lin

(57) ABSTRACT

The modular free-standing ballasted guardrail system comprises: a support foot, attachable stanchion, leverage bar, and counterweight bases. T-head bolts preferably facilitate a modular assembly process, allowing attachment of the stanchion, leverage bar, and counterweights to the foot. The counterweight bases may be made of durable material like HDPE filled with cement or water. The support foot may feature channels for slidable receipt of the stanchion and leverage bar.

25 Claims, 7 Drawing Sheets

(58) Field of Classification Search
CPC ..... E04G 5/14; E04G 5/145; E04G 21/32; E04G 21/3204; E04G 21/3233; E04G 21/3238; E04G 21/3242; Y10S 52/12; Y10S 256/06; Y10T 16/82
USPC ..... 256/59, 64, 65.01, 65.02, 65.14, 65.15, 256/DIG. 6; 182/113; 52/DIG. 12; 16/400
See application file for complete search history.

(56) References Cited

U.S. PATENT DOCUMENTS

| | | | | |
|---|---|---|---|---|
| 10,006,220 | B2 * | 6/2018 | Lee | E01F 9/692 |
| 10,458,133 | B2 * | 10/2019 | Davis | E04G 21/3233 |
| 10,731,373 | B2 * | 8/2020 | Lomax | E04H 12/2238 |
| 2003/0085393 | A1 | 5/2003 | Higgs et al. | |
| 2007/0170411 | A1 * | 7/2007 | Ribak | E01F 13/022 256/32 |
| 2017/0152674 | A1 | 6/2017 | MacKarvich | |

FOREIGN PATENT DOCUMENTS

| | | | | | |
|---|---|---|---|---|---|
| EP | 1484461 | A1 | | 12/2004 | |
| EP | 2525018 | A1 | | 11/2012 | |
| EP | 2525019 | A1 | * | 11/2012 | E04G 21/3238 |
| FR | 2960249 | A1 | | 11/2011 | |
| FR | 3012487 | A1 | * | 5/2015 | E04G 21/3238 |
| FR | 3032737 | A1 | * | 8/2016 | E04G 21/3238 |
| GB | 2392198 | A | * | 2/2004 | E04G 21/3238 |
| GB | 2518294 | B | | 3/2017 | |
| WO | 2005035907 | A1 | | 4/2005 | |
| WO | 2014072413 | A1 | | 5/2014 | |
| WO | 2020016523 | A1 | | 1/2020 | |

OTHER PUBLICATIONS

International-type search dated Mar. 8, 2023 from Australia Application No. 2022903834 (11 pages).

* cited by examiner

MODULAR FREE-STANDING BALLASTED GUARDRAIL SYSTEM

FIELD OF THE INVENTION

This invention relates generally to a type of free-standing ballasted guardrail system.

BACKGROUND OF THE INVENTION

Temporary protective guardrails or balustrade systems are crucial safety measures employed on rooftop surfaces and elevated structures, to safeguard personnel from the risk of falling off edges during construction or maintenance activities.

These temporary safety installations are designed with the primary objective of providing a reliable protective barrier that can arrest a person's fall, thus preventing potentially severe injuries.

The installation process typically involves a step-by-step safety approach. Firstly, the perimeter of the roof or structure is carefully assessed to determine the optimal locations for the guardrails. Once identified the guardrails are securely anchored to the roof surface, using specialised clamps or brackets that do not compromise the structural integrity of the roof or structure. These systems are often adjustable to accommodate various roof profile and surface configurations and applications.

Overall, these guardrail systems play a pivotal role in fostering a secure working environment at heights, by mitigating the risk of falls and enhancing the overall safety of personnel working on rooftops and elevated structures.

One common type of guardrail system that utilises ballasted counterweights is the non-penetrating or free-standing ballasted guardrail system. This system is particularly useful in situations where it is not feasible or permissible to secure the guardrail directly to the roof surface. The free-standing design of this guardrail system involves a series of posts or stanchions, that are strategically placed along the perimeter of the roof or structure. These posts or stanchions are connected by horizontal guardrails to create a protective barrier.

The key innovation in this guardrail system lies in the use of ballasted counterweights to provide stability, and prevent the guardrails from tipping over. Typically large and heavy counterweights such as concrete blocks act as a stabilising force, by anchoring the guardrail system in place without the need for penetration or attachment to the roof or surface itself. The weight and strategic placement of the counterweights are carefully calculated, to ensure that the guardrail system complies with safety standards and regulations, and effectively resists the forces that may be applied to it.

The advantage of a non-penetrating guardrail system with counterweights is its minimal impact on the roof or structure surface. It can be easily installed and removed without causing damage to the roof membrane, making it an ideal solution for temporary safety applications or situations, where maintaining the integrity of the roof or structure is a priority.

SUMMARY OF THE DISCLOSURE

The described modular free-standing ballasted guardrail system comprises several components, including a support foot, a guardrail stanchion attachable to the support foot, a leverage bar also attachable to the support foot, and a counterweight base.

In a first possible configuration, the counterweight base is attached directly to the support foot without the leverage bar, and preferably presses down directly on the support foot. In a second possible configuration, the counterweight base is attached directly to the leverage bar and is separated from the support foot.

In a third possible configuration, an additional counterweight base is stacked on top of the first one, with both being attached directly to the support foot.

In a fourth possible configuration, additional counterweight bases are stacked on top of the leverage bar. In a fifth possible configuration, the counterweight base is attached directly to the support foot, and an adjacent additional counterweight base is attached directly to the leverage bar.

These various configurations of the modular free-standing ballasted guardrail system accordingly offer distinct advantages in addressing different safety and structural requirements. In the first configuration, the counterweight base attached directly to the support foot provides a straightforward and low-profile solution. The counterweight base preferably presses directly on the support foot for frictional engagement against the roof surface without penetration. A friction enhancing pad attached to the proximal end of the support foot, may operably interface the undersurface of the support foot.

The second configuration introduces flexibility by attaching the counterweight base to the leverage bar, allowing for a spatial separation from the support foot, and providing cantilever leverage for enhanced resilience against the guardrail tipping over. This spatial separation in the second configuration also enables a more versatile positioning of the counterweight base, facilitating specific guardrail system applications.

In the third and fourth configuration, stacking counterweight bases directly onto the support foot or leverage bar, enhances the weight and stability of the guardrail system and provides an option for increased load-bearing capacity.

Lastly in the fifth configuration, attaching the counterweight base directly to the support foot, and attaching an adjacent additional counterweight base directly to the leverage bar, provides a further option for a low-profile installation and increased load-bearing capacity.

The ability to choose from these various configurations, allows the modular free-standing ballasted guardrail system to be tailored to different working environments and safety requirements, providing a versatile and effective solution for personnel fall protection on rooftops and elevated structures.

Preferably the guardrail system uses a set of T-head bolts for modular assembly, to facilitate easy and adjustable attachment of the stanchion, the leverage bar, and the counterweight bases to the support foot. This design enables quick insertion into and sliding along the various attachment channels, providing a degree of flexibility during assembly. The T-head bolts permit secure engagement by means of a twisting motion, allowing them to lock into place for fitting with flanged serrated hexagon locknuts and flat round washers, ensuring stability and preventing unintentional disassembly of the guardrail system components. This feature facilitates efficient and straightforward installation, making the modular assembly process user-friendly and adaptable to various configurations and applications.

An optional toe board enhances safety by providing a protective barrier at the base of the guardrail. The toe board is attachable to the support foot of the guardrail system by means of an attachment bracket. This bracket featuring a web, a toe board engaging flange and a support foot engaging flange, facilitates secure attachment to the support foot by means of a T-head bolt and hexagon locknut. The toe board itself has dual rear side longitudinal attachment channels interfacing with two spaced notches on the attachment bracket engaging flange, and facilitating secure attachment by means of cup-head bolts and hexagon locknuts. This configuration creates a sturdy toe board that effectively prevents objects or debris from falling off the edge of the protected rooftop or structure area, further ensuring the safety of personnel working in proximity to the guardrail system.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
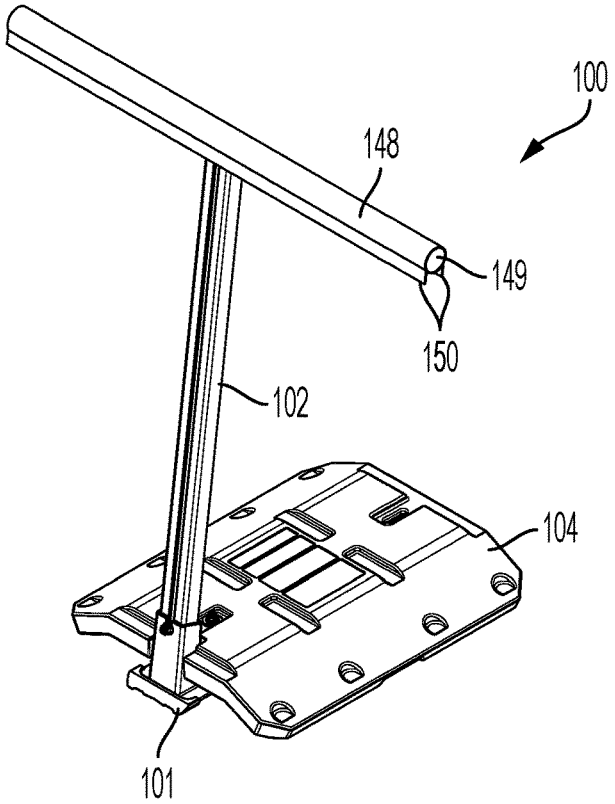
FIG. 1 shows a modular free-standing ballasted guardrail system in a first configuration.

A modular free-standing ballasted guardrail system 100 comprises a support foot 101, a guardrail stanchion 102 attachable to the support foot 101, a leverage bar 103 attachable to the support foot 101, and a counterweight base 104.

A series of stanchions 102 in alignment support a horizontal guardrail 148. In the embodiments shown, the horizontal guardrail 148 comprises a cylindrical cross-section 149 and a pair of parallel flanges 150, defining a gap therebetween which accommodates an upper end of the stanchion 102.

FIG. 1 shows the guardrail system 100 in a first configuration, wherein the counterweight base 104 is attached directly to the support foot 101 without the leverage bar 103. In this configuration, the counterweight base 104 preferably presses down directly onto the support foot 101.

Figure 2:
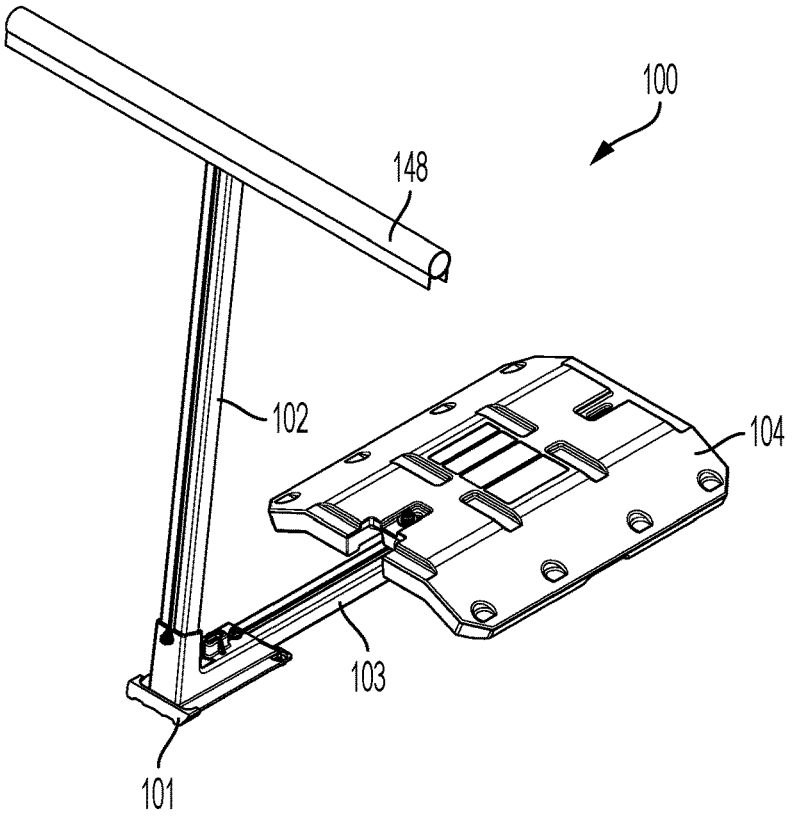
FIG. 2 shows the guardrail system in a second configuration.

FIG. 2 shows the guardrail system 100 in a second configuration, wherein the counterweight base 104 is attached directly to the leverage bar 103, the leverage bar 103 is attached to the support foot 101, and the counterweight base 104 is spaced away from the support foot 101.

Figure 3:
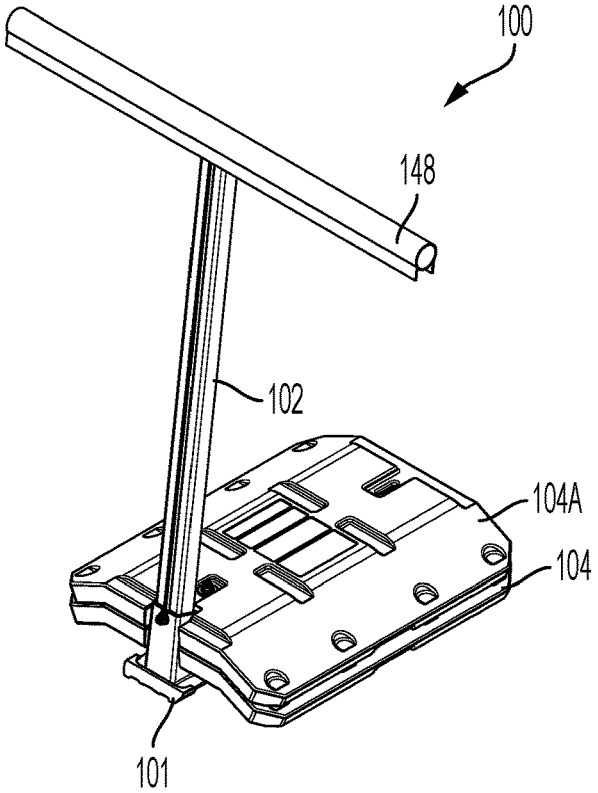
FIG. 3 shows the guardrail system in a third configuration.

FIG. 3 shows the guardrail system 100 in a third configuration, wherein the counterweight base 104 is attached directly to the support foot 101 without the leverage bar 103 and an additional counterweight base 104A is stacked on top of the counterweight base 104. The counterweight base 104 and the additional counterweight base 104A preferably press down directly onto the support foot 101.

In a fourth configuration of the guardrail system 100 (not shown), the counterweight base 104 and the additional counterweight base 104A are stacked on top of the leverage bar 103.

In a fifth configuration of the guardrail system 100 (not shown), the counterweight base 104 engages the support foot 101 directly, and the leverage bar 103 engaging the support foot 101 runs thereunderneath, to be engaged by the additional counterweight base 104A adjacent to the counterweight base 104. Further additional counterweight bases 104A may be stacked on top of the counterweight base 104 and/or the additional counterweight base 104A.

The counterweight base 104 may consist of a shell of durable plastic such as HDPE, which is ballasted by injecting cement or water.

Figure 7:
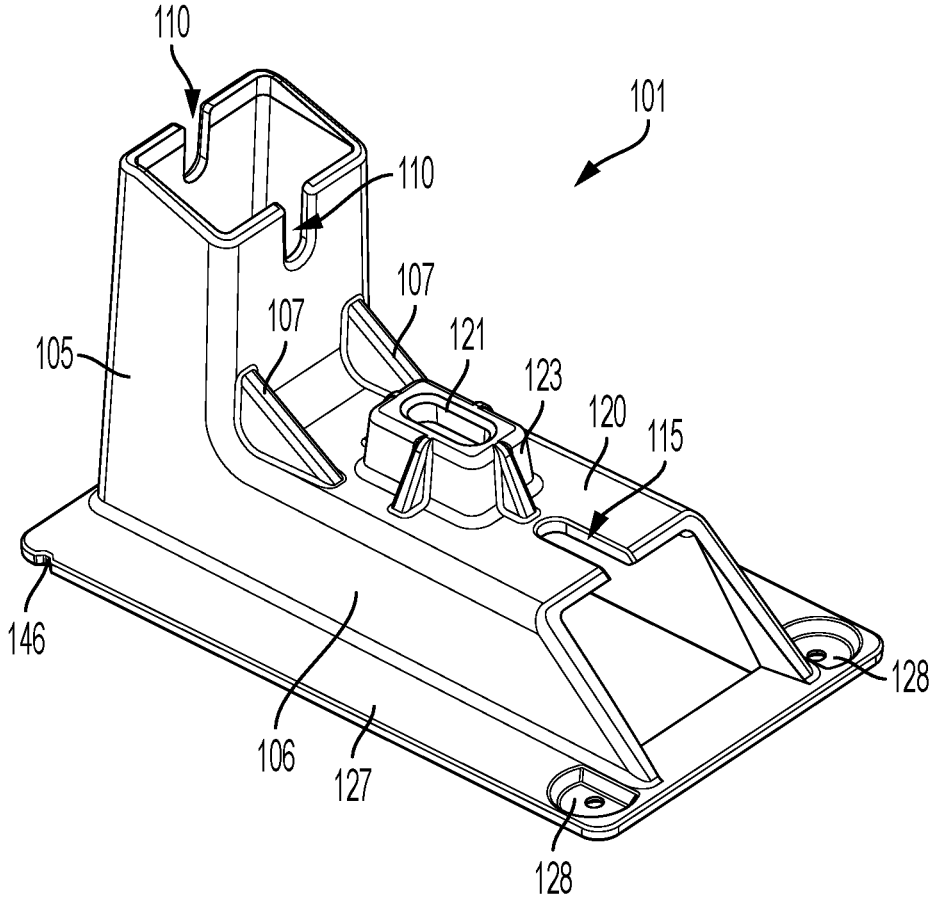
FIG. 7 shows a perspective view of the guardrail system support foot.

FIG. 7 shows a perspective view of the support foot 101, which may define a stanchion engaging channel 105 for attachment of the stanchion 102, and a leverage bar engaging channel 106 for attachment of the leverage bar 103. In the embodiment shown, these portions 105, 106 form rectangular channels for the slidable receipt of the stanchion 102 or the leverage bar 103 respectively. The support foot 101 may be of cast metal.

These portions 105 and 106 may be angled at less than 90° with respect to each other, such that the stanchion 102 is angled towards the counterweight base 104. A pair of parallel bracing flanges 107 may integrally brace the channel portions 105 and 106 apart.

Figure 4:
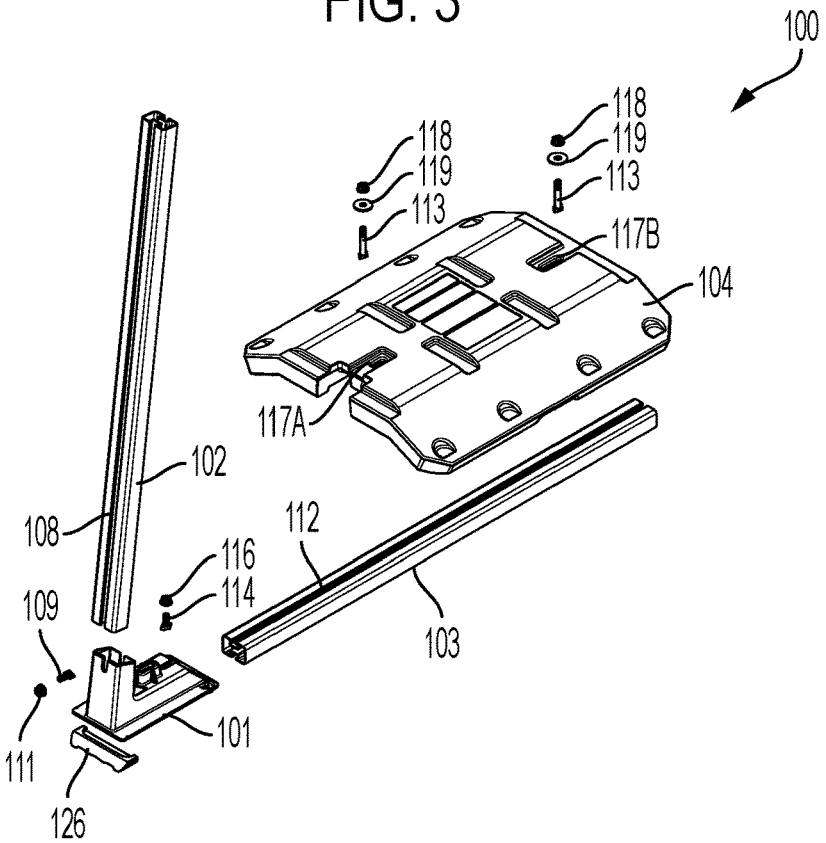
FIG. 4 shows an exploded view of the guardrail system in the second configuration.

FIG. 4 shows an exploded view of the guardrail system, wherein the stanchion 102 may define a longitudinal attachment channel 108 engageable by means of a T-head bolt 109 having a head which has a width less than the width of the attachment channel 108, but a length greater than the width of the attachment channel 108. As such, when the head is in alignment with the attachment channel 108, the T-head bolt 109 can be inserted into the attachment channel 108 anywhere therealong, and then twisted out of alignment such that the head locks into the attachment channel 108 and cannot be withdrawn therefrom. This design facilitates the T-head bolt 109 being easily inserted and slid into position along the attachment channel 108, providing a degree of adjustability.

With further reference to FIGS. 4 and 7, the stanchion engaging channel 105 of the support foot 101 may have a proximal notch 110 to accommodate a stem of the T-head bolt 109 therethrough, and wherein a hexagon locknut 111 tightens on the stem against the proximal notch 110 to lock the stanchion 102 into the stanchion engaging channel 105.

As such, attaching the stanchion 102 to the support foot 101 may require inserting and aligning the T-head bolt 109 into the attachment channel 108, and screwing the hexagon locknut 111 onto the stem thereof. The lower end of the stanchion 102 can then be inserted into the stanchion engaging channel 105, and the T-head bolt 109 slid along the attachment channel 108 until the stem thereof locates into the proximal notch 110. The hexagon locknut 111 may then be tightened to lock the stanchion 102 into the support foot 101.

Preferably the stanchion engaging channel 105 of the support foot 101 may have opposing proximal notches 110 for interfacing either of the respective dual attachment channels 108 of the stanchion 102.

The leverage bar 103 may define a longitudinal attachment channel 112 engageable by means of a T-head bolt 114. Furthermore, the leverage bar engaging channel 106 of the support foot 101 may have a distal notch 115 to accommodate the stem of the T-head bolt 114, and wherein a hexagon locknut 116 tightens on the stem against the distal notch 115, to lock the leverage bar 103 into the leverage bar engaging channel 106.

As such, attaching the leverage bar 103 to the support foot 101 may be similar to the aforedescribed procedure, wherein the T-head bolt 114 is inserted and aligned into the attachment channel 112 of the leverage bar 103, and the hexagon locknut 116 screwed onto the stem thereof. The proximal end of the leverage bar 103 can then be inserted into the leverage bar engaging channel 106 of the support foot 101, and the T-head bolt 114 slid along the attachment channel 112 until the stem thereof engages within the distal notch 115. The hexagon locknut 116 can then be tightened against the distal notch 115 thereby locking the proximal end of the leverage bar 103 into the support foot 101.

Figure 14:
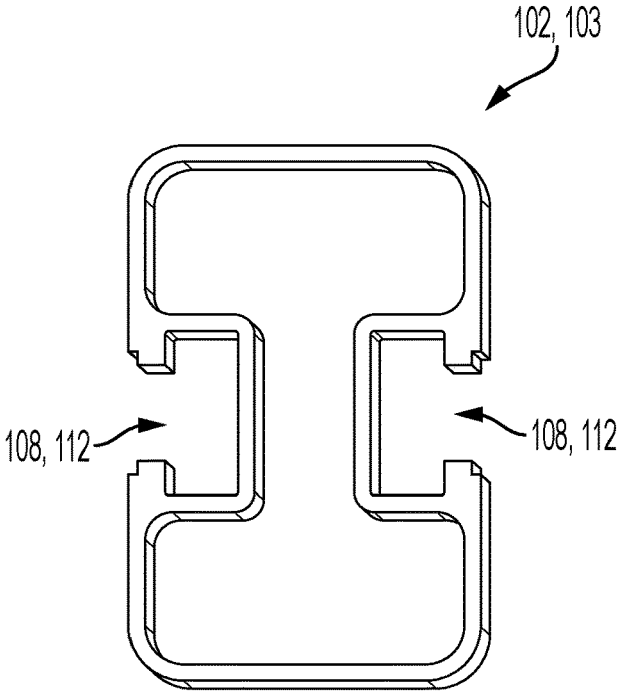
FIG. 14 shows a cross-sectional view of the guardrail system stanchion and leverage bar.

FIG. 14 shows a cross-sectional view of the stanchion 102 and the leverage bar 103 aluminium extrusions. It can be appreciated that both the stanchion 102 and the leverage bar 103 being symmetrical, may constitute identical cross sections thereby facilitating interchangeable usage in the guardrail system.

With further reference to FIG. 4, the counterweight base 104 may comprise an aperture 117 for inserting a stem of a T-head bolt 113. Each aperture 117 may be elongate so as to accommodate the T-head of the bolt 113 therethrough. The T-head bolt 113 may be inserted through the aperture 117 and the T-head thereof engaged within the attachment channel 112 of the leverage bar 103. The hexagon locknut 118 which may interface a flat round washer 119, is tightened around the aperture 117 thereby locking the counterweight base 104 onto the leverage bar 103. According to the preferred embodiment shown, the counterweight base 104 may comprise a proximal aperture 117A and a distal aperture 117B at opposite ends thereof, for respective T-head bolts 113, flat round washers 119 and hexagon locknuts 118, to facilitate the counterweight base 104 being secured to the leverage bar 103 simultaneously by means of these two sets of fasteners.

Longer T-head bolts 122A may be used to secure additional stacked counterweight bases 104A to the leverage bar 103. The counterweight base 104 may define an upper surface channel within which the aperture 117 is recessed, to accommodate the hexagon locknut 118 and the flat round washer 119, and to reduce or eliminate snag points.

Figure 5:
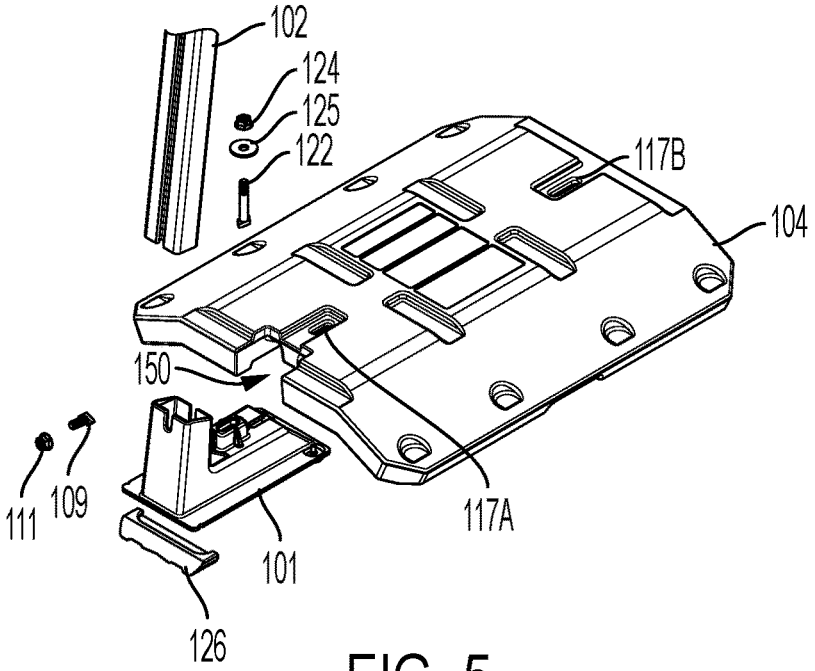
FIG. 5 shows an exploded view of the guardrail system in the first configuration.

With further reference to FIGS. 5 and 7, the leverage bar engaging channel 106 may define an aperture 121 engageable by a T-head bolt 122. The aperture 121 may be raised with respect to the distal notch 115 within a surrounding buttress 123 of the support foot 101.

The T-head of the bolt 122 is configured to insert through the proximal aperture 117A of the counterweight base 104 and into the aperture 121 of the support foot 101. The aperture 121 is elongate to facilitate inserting the head of the T-head bolt 122 therethrough, and to lock around the aperture 121 when the head is twisted out of alignment.

A hexagon locknut 124 which may interface a flat round washer 125 on a stem of the T-head bolt 122, thereby tightens against the proximal aperture 117A to lock the counterweight base 104 directly onto the support foot 101.

Figure 6:
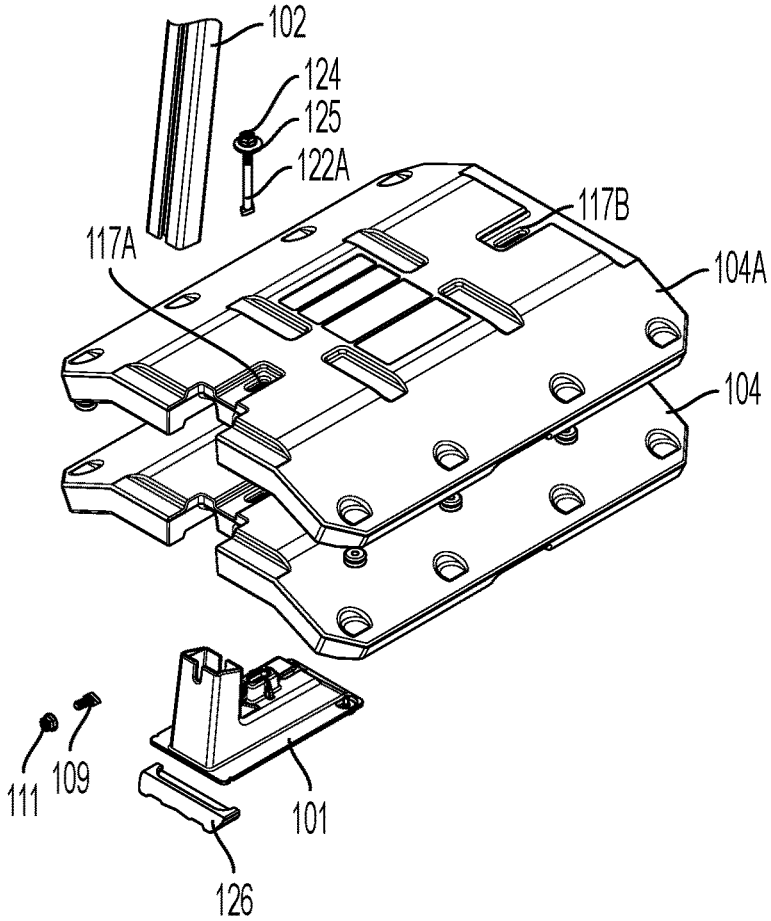
FIG. 6 shows an exploded view of the guardrail system in the third configuration.

FIG. 6 shows an exploded view of an embodiment of the guardrail system 100, wherein a longer T-head bolt 122A may be inserted through additional stacked counterweight bases 104A to engage the support foot 101. A hexagon locknut 124 which may interface a flat round washer 125 on a stem of the longer T-head bolt 122A, may similarly lock the stacked counterweight bases 104A onto the support foot 101.

Figure 12:
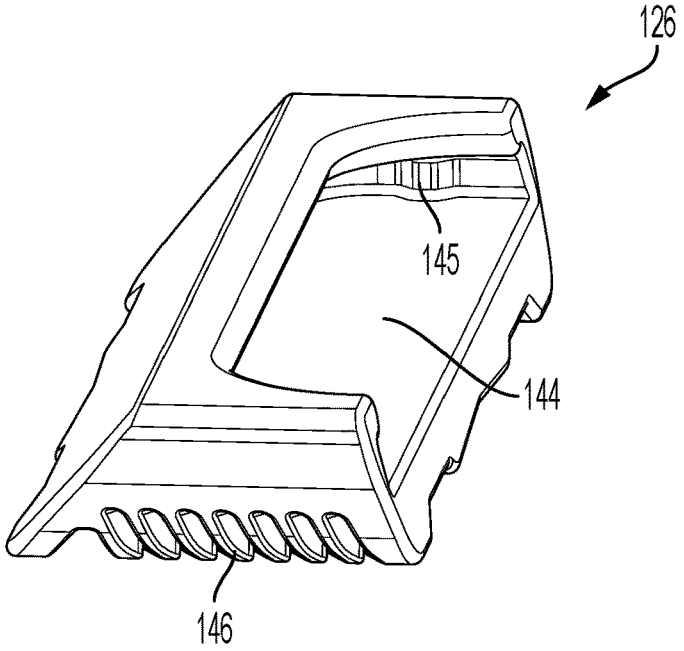
FIG. 12 shows a perspective view of a friction enhancing pad attachable to the support foot, in accordance with an embodiment.
Figure 13:
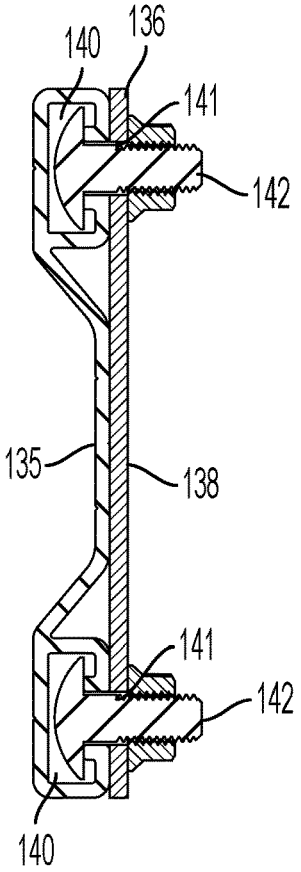
FIG. 13 shows a cross-sectional view of the toe board and attachment bracket flange.

FIG. 12 shows a perspective view of a friction enhancing pad 126, which may be attached to an undersurface 127 of the support foot 101, to enhance the frictional interface with the underlying surface of a roof or structure.

With further reference to FIGS. 5, 7 and 12, the friction enhancing pad 126 may define a recess 144 shaped to fit around the proximal edge of an undersurface 127 of the support foot 101. The recess 144 may comprise side protrusions 145 which grip into corresponding indentations 146 of the undersurface 127.

The friction enhancing pad 126 may have friction profile formations 146 thereunder, such as of an integral ribbed or comb structure. As can be appreciated from the first configuration shown in FIG. 1 and the support foot 101 shown in FIG. 7, the counterweight base 104 preferably pressing down directly on the support foot 101 thereby applies direct force onto the friction enhancing pad 126. In this regard it should be noted that the leverage bar engaging channel 106 may define a flat upper surface 120, upon which a corresponding flat undersurface 151 of the counterweight base 104 lies flush.

With further reference to FIG. 7, the undersurface 127 may comprise sockets 128 for accommodating friction enhancing rubber grommets (not shown), at the distal end of the support foot 101 opposite to the friction enhancing pad 126.

Figure 8:
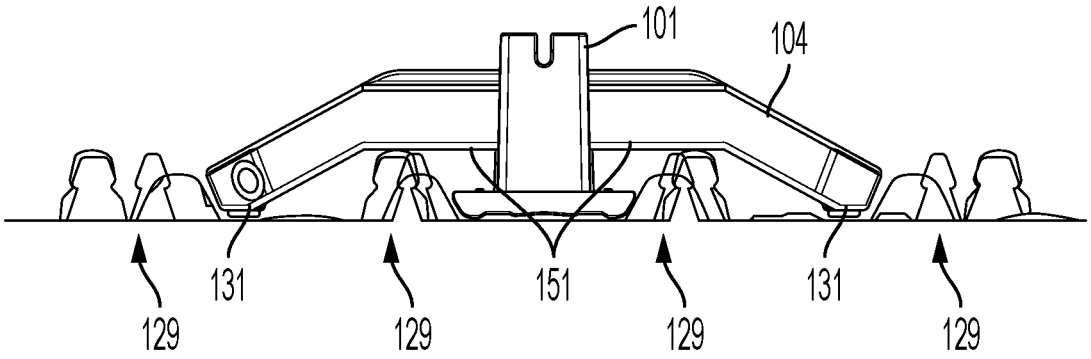
FIG. 8 shows a proximal end view of the guardrail system counterweight base, attached to the support foot and fitting over and between typical roof profile formations.

FIG. 8 shows the proximal end view of the counterweight base 104, which may define a domed cross section flat undersurface 151 thereby allowing a clear space either side of the support foot 101. As illustrated the support foot 101 may thereby locate directly between various roof profile formations 129, and whereas the outer side edges 131 of the counterweight base 104 may locate between corresponding adjacent roof profile formations 129.

Figure 9:
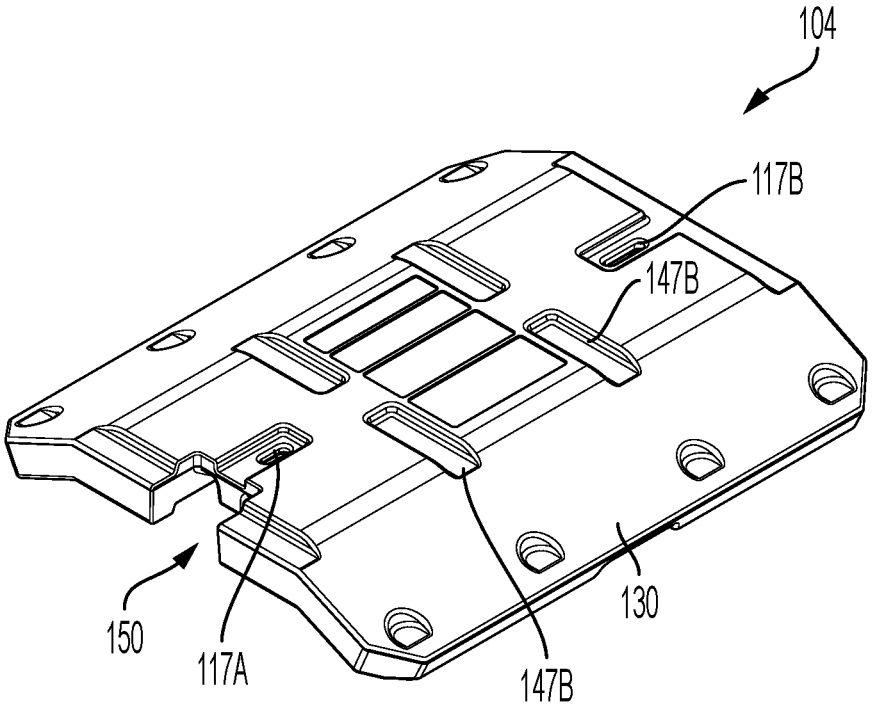
FIG. 9 shows a top perspective view of the guardrail system counterweight base.

FIG. 9 shows the top perspective view of the counterweight base 104, which may define a notch 150 in the proximal end thereof which is configured to accommodate the stanchion engaging channel 105 therein, such that the counterweight base 104 can surround the support foot 101 and press down directly thereon as illustrated in FIG. 1.

Figure 10:
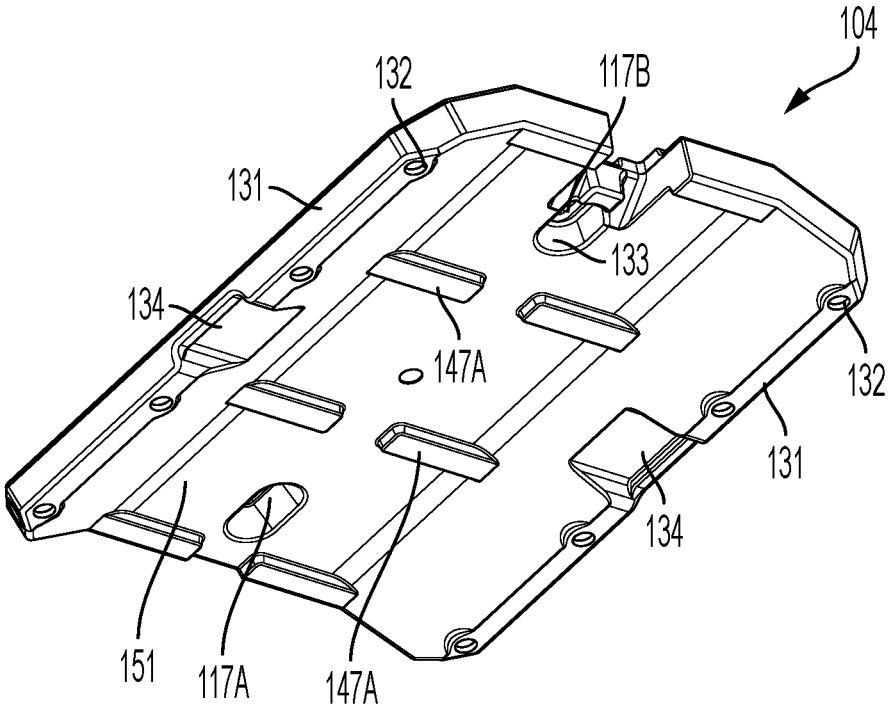
FIG. 10 shows a bottom perspective view of the guardrail system counterweight base.

FIG. 10 shows the bottom perspective view of the counterweight base 104, whereby the aforedescribed domed cross section may define outer side edges 131, which may be interspersed with sockets 132 for accommodating friction enhancing rubber grommets (not shown). The outer side edges 131 may further define grab handle recesses 134 to facilitate lifting off the counterweight base 104 using both hands.

With further reference to FIG. 10, the flat undersurface 151 of the counterweight base 104 may defines a recess 133 to accommodate the buttress 123 of the foot 101 therein.

Further to FIGS. 9 and 10, the domed upper surface 130 of the counterweight base 104 may define complimentary interlocking recesses 147B, to facilitate interfacing with corresponding interlocking protrusions 147A, which may be defined on the flat undersurface 151 of stacked additional counterweight bases 104A, in the respective third, fourth and fifth configurations. These interfacing recesses and protrusions 147 may be elongate with respect to a cross axis of the counterweight base 104, to resist longitudinal movement thereby, whereas the domed profile of the counterweight base 104 resists lateral movement thereby.

Figure 11:
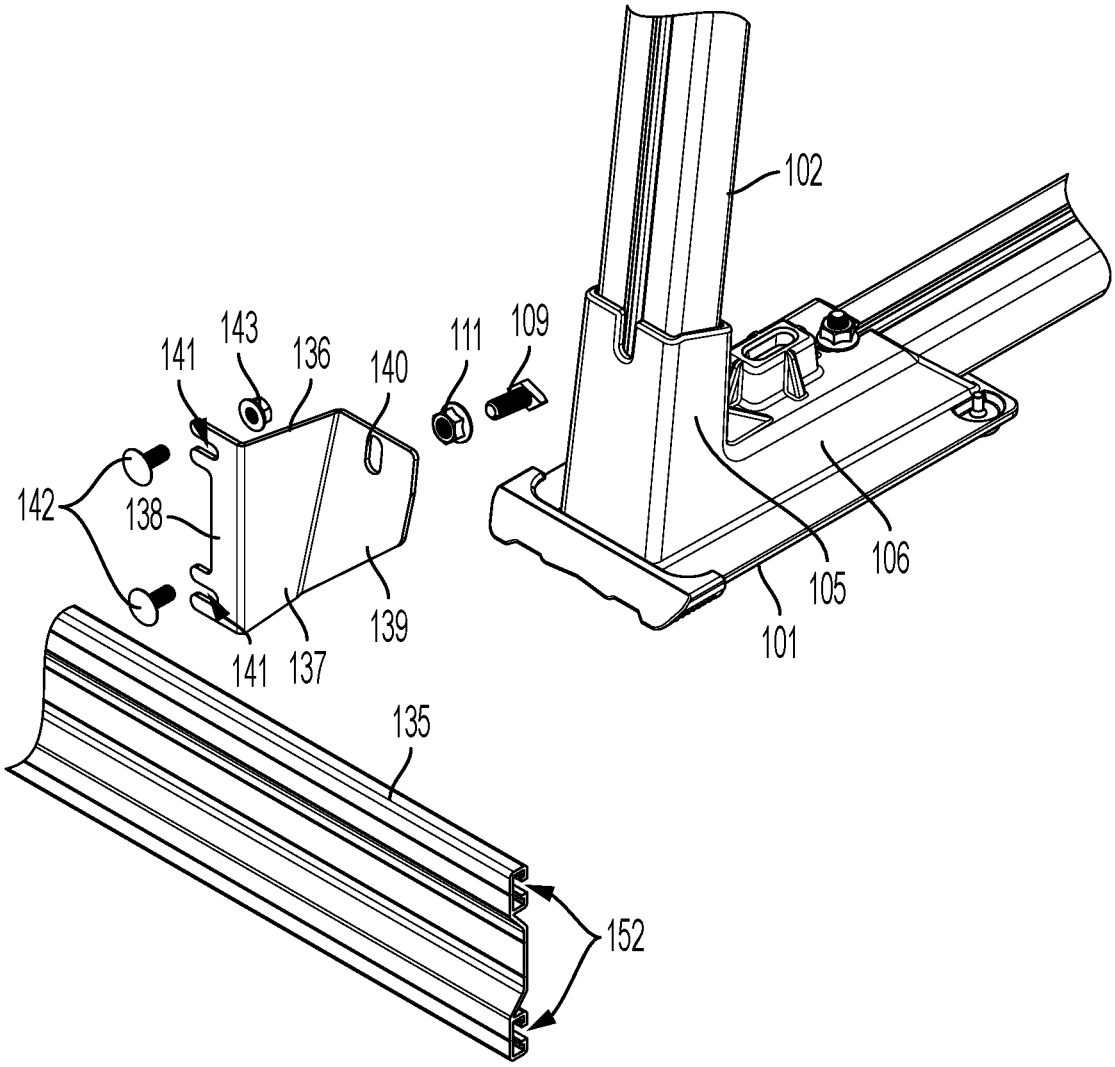
FIG. 11 shows an exploded view of a toe board attachable to the support foot of the guardrail system.

FIG. 11 shows an exploded view of a further embodiment of the guardrail system 100, wherein an aluminium extrusion toe board 135 may be attachable to the support foot 101 by means of a stainless-steel attachment bracket 136.

The attachment bracket 136 may have a web 137 orthogonally interfacing a toe board engaging flange 138 and a support foot engaging flange 139. As illustrated, the support foot engaging flange 139 may be at an angle with respect to the web 137, to correspond with the stanchion engaging channel 105 which is set at less than 90 degrees with respect to the leverage bar engaging channel 106.

The support foot engaging flange 139 may comprise a slotted aperture 140 whereby the attachment bracket 136 may be attached to the support foot 101, by means of the same afore described T-head bolt 109 and hexagon locknut 111, as used for locking the stanchion 102 to the stanchion engaging channel 105.

The toe board 135 may define a pair of rear side longitudinal attachment channels 152, and wherein the toe board engaging flange 138 may comprise correspondingly spaced notches 141. Cup head bolts 142 may be slidably inserted into the respective attachment channels 152, and slid therealong into alignment with the notches 141, whereafter they may be secured by means of hexagon locknuts 143.

The foregoing description for purposes of explanation, used specific nomenclature to provide a thorough understanding of the invention. However, it will be apparent to one skilled in the art that specific details are not required in order to practise the invention. Thus the foregoing descriptions of specific embodiments of the invention are presented for purposes of illustration and description. They are not intended to be exhaustive or to limit the invention to the precise forms disclosed, as obviously many modifications and variations are possible in view of the above teachings. The embodiments were chosen and described in order to best explain the principles of the invention and its practical applications, thereby enabling others skilled in the art to best utilise the invention and various embodiments, with various modifications as are suited to the particular use contemplated. It is intended that the following claims and their equivalents define the scope of the invention.

The invention claimed is:

1. A modular free-standing ballasted guardrail system comprising:

a support foot;

a guardrail stanchion attachable to the support foot;

a leverage bar attachable to the support foot;

a counterweight base, wherein the guardrail system is configurable in:

a first configuration wherein the counterweight base is attached directly to the support foot without the leverage bar; and a second configuration wherein the counterweight base is attached directly to the leverage bar, the leverage bar is attached to the support foot, and the counterweight base is spaced away from the support foot;

wherein the support foot defines a stanchion engaging channel for slidable receipt of the stanchion therein;

wherein the stanchion defines a longitudinal attachment channel engageable by means of a T-head bolt;

wherein the stanchion engaging channel of the support foot has a proximal notch to accommodate a stem of the T-head bolt; and wherein a nut on the stem tightens against the proximal notch to lock the stanchion into the stanchion engaging channel.

2. The guardrail system as claimed in claim 1, wherein the guardrail system is further configurable in a further configuration wherein the counterweight base is attached directly to the support foot without the leverage bar and an additional counterweight base is stacked on top of the counterweight base.

3. The guardrail system as claimed in claim 1, wherein the guardrail system is further configurable in a further configuration wherein the counterweight base is attached directly to the leverage bar, the leverage bar is attached to the support foot, the counterweight base is spaced away from the support foot and an additional counterweight base is stacked on top of the counterweight base.

4. The guardrail system as claimed in claim 1, wherein the guardrail system is further configurable in a further configuration wherein the counterweight base is attached directly to the support foot, the leverage bar is attached to the support foot and an additional counterweight base attached directly to the leverage bar.

5. The guardrail system as claimed in claim 1, wherein the counterweight base defines interlocking formations on upper and lower surfaces thereof for interlocking with corresponding formations of adjacently stacked additional counterweight bases.

6. The guardrail system as claimed in claim 1, wherein the stanchion defines opposing longitudinal attachment channels, and wherein the stanchion engaging channel defines respective opposing proximal notches therefor.

7. The guardrail system as claimed in claim 1, wherein the support foot defines a stanchion engaging channel for slidable receipt of the stanchion therein, and a leverage bar engaging channel for slidable receipt of the leverage bar therein, and wherein the stanchion and leverage bar engaging channels are orientated at an angle of less than 90° with respect to each other.

8. The guardrail system as claimed in claim 1, wherein the support foot has a friction enhancing pad attached to the proximal end thereof, and operable at an undersurface thereof and wherein, in the first configuration, the counterweight base presses down on the foot.

9. The guardrail system as claimed in claim 1, wherein the counterweight base has a domed undersurface cross-section which allows a space on either side of the support foot, when the counterweight base is attached thereto.

10. The guardrail system as claimed in claim 1, wherein the support foot defines a stanchion engaging channel for slidable receipt of the stanchion therein, and wherein the counterweight base defines a notch configured to accommodate the stanchion engaging channel.

11. The guardrail system as claimed in claim 1, wherein the side edges of the counterweight base are interspersed with sockets for inserting friction enhancing rubber grommets therein.

12. The guardrail system as claimed in claim 1, wherein the side edges of the counterweight base further define grab handle recesses.

13. A modular free-standing ballasted guardrail system comprising:

a support foot;

a guardrail stanchion attachable to the support foot;

a leverage bar attachable to the support foot;

a counterweight base, wherein the guardrail system is configurable in:

a first configuration wherein the counterweight base is attached directly to the support foot without the leverage bar; and a second configuration wherein the counterweight base is attached directly to the leverage bar, the leverage bar is attached to the support foot, and the counterweight base is spaced away from the support foot;

wherein the support foot defines a leverage bar engaging channel for slidable receipt of the leverage bar therein;

wherein the leverage bar defines a longitudinal attachment channel engageable by means of a T-head bolt; and wherein the leverage bar engaging channel has a notch to accommodate a stem of the T-head bolt, and wherein a nut on the stem tightens around the notch to lock the leverage bar into the leverage bar engaging channel.

14. A modular free-standing ballasted guardrail system comprising:

a support foot;

a guardrail stanchion attachable to the support foot;

a leverage bar attachable to the support foot;

a counterweight base, wherein the guardrail system is configurable in:

a first configuration wherein the counterweight base is attached directly to the support foot without the leverage bar; and a second configuration wherein the counterweight base is attached directly to the leverage bar, the leverage bar is attached to the support foot, and the counterweight base is spaced away from the support foot;

wherein the leverage bar defines a longitudinal attachment channel engageable by a T-head bolt, and wherein the counterweight base has an aperture for a stem of the T-head bolt, and wherein a nut on the stem tightens around the aperture to lock the counterweight base against the leverage bar.

15. The guardrail system as claimed in claim 14, wherein the aperture is elongate and has a length greater than a head of the T-head bolt.

16. The guardrail system as claimed in claim 14, wherein the counterweight base defines apertures at proximal and distal ends thereof, for simultaneous attachment to the leverage bar by means of respective T-head bolts.

17. The guardrail system as claimed in claim 14, wherein the T-head bolt has a length sufficient to insert through aligned apertures of more than one counterweight base stacked on top of each other.

18. A modular free-standing ballasted guardrail system comprising:

a support foot;

a guardrail stanchion attachable to the support foot;

a leverage bar attachable to the support foot;

a counterweight base, wherein the guardrail system is configurable in:

a first configuration wherein the counterweight base is attached directly to the support foot without the leverage bar; and a second configuration wherein the counterweight base is attached directly to the leverage bar, the leverage bar is attached to the support foot, and the counterweight base is spaced away from the support foot;

wherein the support foot defines a leverage bar engaging channel for slidable receipt of the leverage bar therein, and wherein the leverage bar engaging channel defines an aperture engageable by means of a T-head bolt, and wherein the counterweight base has an aperture for a stem of the T-head bolt therethrough, and wherein a nut on the stem tightens around the aperture to lock the counterweight base against the leverage bar engaging channel.

19. The guardrail system as claimed in claim 18, wherein the apertures each have a length greater than a head of the T-head bolt, and a width less than the head.

20. The guardrail system as claimed in claim 18, wherein the aperture of the support foot is defined in a buttress on an upper surface of the leverage bar engaging channel.

21. The guardrail system as claimed in claim 18, wherein the stem of the T- head bolt has a length sufficient to insert through aligned apertures of more than one counterweight base stacked on top of the support foot.

22. A modular free-standing ballasted guardrail system comprising:

a support foot;

a guardrail stanchion attachable to the support foot;

a leverage bar attachable to the support foot;1 a counterweight base, wherein the guardrail system is configurable in:

a first configuration wherein the counterweight base is attached directly to the support foot without the leverage bar; and a second configuration wherein the counterweight base is attached directly to the leverage bar, the leverage bar is attached to the support foot, and the counterweight base is spaced away from the support foot;

wherein a toe board is attachable to the support foot by means of an attachment bracket, the attachment bracket comprising a web, a toe board engaging flange and a support foot engaging flange.

23. The guardrail system as claimed in claim 22, wherein the support foot engaging flange comprises a slotted aperture for fixing the attachment bracket to the support foot by means of a T-head bolt and nut, and wherein the T-head bolt simultaneously locks into a notch of a stanchion engaging channel of the support foot, and a longitudinal attachment channel of the stanchion.

24. The guardrail system as claimed in claim 22, wherein the toe board defines a pair of rear side longitudinal attachment channels, and wherein the toe board engaging flange is configured to engage heads of bolts slidably inserted within the respective longitudinal attachment channels of the toe board.

25. The guardrail system as claimed in claim 22, wherein the support foot engaging flange is configured at an angle with respect to the web, corresponding to an angle of a stanchion engaging channel of the support foot.

* * * * *